US007313336B2

(12) United States Patent
Kadota et al.

(10) Patent No.: US 7,313,336 B2
(45) Date of Patent: Dec. 25, 2007

(54) METHOD AND APPARATUS FOR IMAGE FORMING CAPABLE OF EFFECTIVELY RECYCLING TONER

(75) Inventors: Ichiro Kadota, Tokyo-to (JP); Atsushi Shinozaki, Chiba-ken (JP); Nekka Matsuura, Kanagawa-ken (JP); Hisashi Shoji, Kanagawa-ken (JP); Kazumi Suzuki, Kanagawa-ken (JP); Nobutaka Takeuchi, Kanagawa-ken (JP); Satoshi Muramatsu, Tokyo-to (JP); Yukio Tabata, Shizuoka-ken (JP); Motohiro Usami, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 333 days.

(21) Appl. No.: 11/181,887

(22) Filed: Jul. 15, 2005

(65) Prior Publication Data

US 2006/0013604 A1 Jan. 19, 2006

(30) Foreign Application Priority Data

Jul. 15, 2004 (JP) ..... 2004-208316

(51) Int. Cl.
*G03G 15/00* (2006.01)

(52) U.S. Cl. ..... 399/49; 399/61; 399/358; 399/360

(58) Field of Classification Search ..... 399/29, 399/38, 49, 58, 61, 358, 360
See application file for complete search history.

(56) References Cited

U.S. PATENT DOCUMENTS 6,658,227 B2 12/2003 Oyama et al.
6,721,534 B2 * 4/2004 Takahashi ..... 399/359
6,782,234 B2 * 8/2004 Takami ..... 399/359
6,856,780 B2 2/2005 Kadota et al.
2005/0088697 A1 4/2005 Yasutomi et al.

(Continued)

FOREIGN PATENT DOCUMENTS

JP 8-63067 3/1996

(Continued)

OTHER PUBLICATIONS

U.S. Appl. No. 11/546,251, filed Oct. 12, 2006, Tsukamoto et al.

(Continued)

*Primary Examiner*—Hoan Tran
(74) *Attorney, Agent, or Firm*—Oblon, Spivak, McClelland, Maier & Neustadt, P.C.

(57) ABSTRACT

An image forming apparatus includes a plurality of color toner development devices, a recycled toner development device, at least one cleaning device, a toner collecting and supplying device, and an image pattern generation device. The plurality of color toner development devices store separate color toners, and the recycled toner development device stores recycled toner. The at least one cleaning device removes toner remaining on at least one image carrying member after a transfer operation. The toner collecting and supplying device stores and supplies the removed toner to the recycled toner development device. The image pattern generation device generates image patterns developed by the plurality of color toner development devices and the recycled toner development device based on a characteristic of developer and a color of the recycled toner stored in the recycled toner development device.

33 Claims, 8 Drawing Sheets

U.S. PATENT DOCUMENTS

2006/0013604 A1 1/2006 Kadota et al.

FOREIGN PATENT DOCUMENTS

| | | |
|---|---|---|
| JP | 10-293432 | 11/1998 |
| JP | 2000-35703 | 2/2000 |
| JP | 2000-267366 | 9/2000 |
| JP | 2003-14911 | 1/2003 |

OTHER PUBLICATIONS

U.S. Appl. No. 11/450,470, filed Jun. 12, 2006, Kadota et al.
U.S. Appl. No. 11/452,411, filed Jun. 14, 2006, Shoji et al.
U.S. Appl. No. 11/181,887, filed Jul. 15, 2005, Kadota et al.

* cited by examiner

METHOD AND APPARATUS FOR IMAGE FORMING CAPABLE OF EFFECTIVELY RECYCLING TONER

CROSS REFERENCE TO RELATED APPLICATION

This application claims priority to Japanese patent application no. 2004-208316 filed on Jul. 15, 2004, the disclosure of which is incorporated by reference herein in its entirety.

BACKGROUND OF THE INVENTION

1. Field of the Invention

The present invention relates to an image forming method and apparatus, such as a copier, a facsimile machine, and a printer, and more particularly to a color image forming method and apparatus according to a dry two-component development system capable of collecting toners from image carrying members or an intermediate transfer member by using cleaning devices and of recycling the collected toners.

2. Discussion of the Background Arts

In a background image forming apparatus according to an electrographic system, optical image data is formed on an image carrying member uniformly charged, and an electrostatic latent image is formed thereon. The electrostatic latent image is developed into a visible image by toner supplied from a development device. The visible image is transferred to an intermediate transfer member and then to a recording medium (e.g., a transfer sheet). Alternatively, the visible image may be directly transferred to the recording medium. The visible image thus transferred is fixed on the recording medium. Accordingly, a toner image is formed on the recording medium.

In a background color image forming apparatus, toner images of four colors are formed on image carrying members and superimposed on an intermediate transfer member or on a recording medium conveyed by a recording medium conveying member such as a transfer belt. Accordingly, a full-color image is formed on the recording medium.

The background color image forming apparatus is either one of following two types. In a first type of color image forming apparatus, the toner images of four colors are sequentially formed on a single image carrying member or two image carrying members. In a second type of color image forming apparatus, an image carrying member, a development device which develops a toner image on the image carrying member, and a cleaning device which removes toner remaining on the image carrying member are provided for each of the four toner colors. The second type of color image forming apparatus usually uses a tandem system, according to which the image carrying members for the respective toner colors are arranged in a line along a moving direction of the intermediate transfer member or the transfer belt. Since the tandem-system color image forming apparatus is capable of forming the toner images of four colors at one time, the color image forming apparatus is operated at a relatively high speed.

Unlike a monochrome image forming apparatus, the color image forming apparatus uses a plurality of toner colors and frequently outputs a document, such as a photo image document, a relatively large space of which is occupied by an image. To reduce resources used by the color image forming apparatus as well as space and running cost of the apparatus, recycling of used toner has been an important issue to be addressed.

In the above-described background color image forming apparatus according to the electrographic system, the toner images of four colors formed on the respective four image carrying members are directly or indirectly superimposed on and transferred to the recording medium, so that a color image is formed thereon. After a transfer operation, a part of toner in the toner image carried by each of the image carrying members remains on the image carrying member without having been transferred to the recording medium. This toner remaining on the image carrying member is removed and collected by the cleaning device provided for each of the image carrying members.

Recycling of the collected toner, however, has a few problems. One of the problems is mixture of toners of different colors caused when a toner of one color stored at an upstream position is mixed into a toner of another color stored at a downstream position in a moving direction of the intermediate transfer member or the transfer belt.

In a tandem-system color image forming apparatus in which an image carrying member is provided for each of different toner colors, a cleaning device collects toner remaining on its corresponding image carrying member. It is therefore relatively easy to collect and recycle the remaining toner for future image forming operations. Further, since image forming systems for the respective toner colors are independent from one another, the mixture of toners of different colors may be considered preventable in the tandem-system color image forming apparatus. In reality, however, the mixture of toners of different colors occurs in a process of transferring toner images of the respective colors from the image carrying members to the recording medium.

Mechanism of mixing of different color toners is described below.

In the tandem-system color image forming apparatus, a color image is formed on the recording medium by, for example, transferring the toner images of the respective colors from the image carrying members to the recording medium conveyed by the transfer belt. In this case, by the time when a second toner in a second toner image carried by a second image carrying member is transferred to the recording medium, for example, the recording medium has already been covered with a first toner in a first toner image carried by a first image carrying member, which is located at an upstream position of the second image carrying member in a moving direction of the recording medium. The first toner transferred to the recording medium is transferred back to the second image carrying member in a transfer process of the second toner, and collected by a second cleaning device provided for the second image carrying member. In this way, the collected first toner mixes into the collected second toner.

In the background color image forming apparatus, therefore, if toner is collected from an image carrying members and directly sent back to a development device for the image carrying member, hue of toner contained in the development device gradually changes over time.

To solve this problem, toner of one color collected and mixed with toner of another color is usually mixed with a black toner for recycling or disposed as waste toner. If all of such toner is mixed into the black toner, however, it becomes difficult to maintain a balance between an amount of toner consumed and an amount of toner supplied to the development device. In an image forming operation of a photo image, for example, a relatively small amount of the black toner may be used. As a result, an amount of toner collected for recycling (i.e., recycled toner) in a cleaning process and supplied to the development device may exceed the amount of toner actually consumed.

To prevent the mixture of toners of different colors, there is an attempt to detect a mixing ratio of different color toners in developer contained in a development device by using a reflectance ratio detector, when recycled toner collected from an image carrying member in the cleaning process is supplied again to the development device for the image carrying member. Accordingly, a ratio between a new toner and the recycled toner to be supplied to the development device is set based on the detected mixing ratio of the different color toners.

There is another attempt to collect toners of the respective colors in one place, and mix and supply the collected toners to a black toner development device.

To prevent toner from being transferred from the recording medium back to the image carrying member, which is caused by inversely charged toner in the toner image formed on the recording medium, there is another attempt to remove electricity from a non-image area. In this attempt, electricity is removed to such a level that toner in a toner image does not scatter before the toner image is transferred.

To address toner aggregation and reduced chargeability of the toners collected for recycling in the cleaning process, another attempt has been made to adjust image forming process conditions by determining a ratio of the recycled toner to be supplied to the development device.

SUMMARY OF THE INVENTION

This patent specification describes an image forming apparatus. In one example, an image forming apparatus includes a plurality of color toner development devices, a recycled toner development device, at least one cleaning device, a toner collecting and supplying device, and an image pattern generation device. The plurality of color toner development devices are configured to store separate color toners. The recycled toner development device is configured to store recycled toner. The at least one cleaning device is configured to remove toner remaining on at least one image carrying member after a transfer operation. The toner collecting and supplying device is configured to store and supply the removed toner to the recycled toner development device. The image pattern generation device is configured to generate image patterns developed by the plurality of color toner development devices and the recycled toner development device, based on a characteristic of developer and a color of the recycled toner stored in the recycled toner development device.

This patent specification further describes another image forming apparatus. In one example, this image forming apparatus includes a latent image forming device, a plurality of development devices, a transfer device, at least one cleaning device, a toner collecting and supplying device, a developer characteristic detection device, a color detection device, and an image pattern generation device. The latent image forming device is configured to form a latent image on at least one image carrying member. The plurality of development devices is configured to store dry developer for developing the latent image into a visible image. The plurality of development devices include a plurality of color toner development devices and a recycled toner development device. The plurality of color toner development devices are configured to store cyan, magenta, yellow, and black toners, respectively, and the recycled toner development device is configured to store recycled toner. The transfer device is configured to transfer the visible image to a recoding medium. The at least one cleaning device is configured to remove toner remaining on the at least one image carrying member after a transfer operation. The toner collecting and supplying device is configured to store and supply the removed toner to the recycled toner development device. The developer characteristic detection device is configured to detect a characteristic of developer stored in the recycled toner development device. The color detection device is configured to detect a color of the recycled toner. The image pattern generation device is configured to generate image patterns developed by the respective plurality of development devices.

In the image forming apparatus, the image pattern generation device may control an amount of toner included in one pixel not to exceed a predetermined value.

In the image forming apparatus, the image forming apparatus may be operated in one of a plurality of image formation modes by which a user determines a use condition of the cyan, magenta, yellow, black, and recycled toners.

In the image forming apparatus, the plurality of color toner development devices excluding the recycled toner development device may be used in an image forming operation in one of the plurality of image formation modes.

In the image forming apparatus, data generation processing of generating image patterns of cyan, magenta, yellow, black, and recycled toners may be performed to preferentially use the recycled toner and reduce consumption of the cyan, magenta, yellow, and black toners in one of the plurality of image formation modes.

In the image forming apparatus, the recycled toner may be exclusively used in an image forming operation in one of the plurality of image formation modes.

In the image forming apparatus, the developer may be dry two-component developer, and the recycled toner development device may not used if toner density of the recycled toner detected by the developer characteristic detection device is lower than a predetermined value.

In the image forming apparatus, the black toner may be used in a development operation, if the image forming apparatus is set to the mode in which the recycled toner is exclusively used in the image forming operation.

In the image forming apparatus, a plurality of image forming units may be arranged in a line, and each of the plurality of image forming units may include an image carrying member. Further, the recycled toner may be stored in one of the plurality of image forming units at a most downstream position in a moving direction of the recording medium.

In the image forming apparatus, the transfer device may include an intermediate transfer member and an intermediate transfer member cleaning device. The intermediate transfer member cleaning device may be configured to contact the intermediate transfer member and to collect toner adhered thereto. When an image forming operation is not performed, the image forming apparatus may be operated, with the recycled toner development device excluding the plurality of color toner development devices driven. A development bias voltage may be applied to generate a development electric field in a direction of not developing normally charged toner. The toner collected by the intermediate transfer member cleaning device may be disposed as waste toner.

This patent specification further describes an image forming method. In one example, an image forming method includes: storing separate color toners in a plurality of color toner development devices; removing toner remaining on at least one image carrying member after a transfer operation;

collecting and supplying the removed toner to a recycled toner development device; and generating image patterns developed by the plurality of color toner development devices and the recycled toner development device, based on a characteristic of developer and a color of the recycled toner stored in the recycled toner development device.

This patent specification describes another image forming method. In one example, this image forming method includes: storing cyan, magenta, yellow, and black toners in separate color toner development devices; forming a latent image on at least one image carrying member; developing the latent image into a visible image; transferring the visible image to a recoding medium; removing toner remaining on the at least one image carrying member after a transfer operation; collecting and supply the removed toner to a recycled toner development device; detecting a characteristic of developer stored in the recycled toner development device; detecting a color of the toner stored in the recycled toner development device; and generating image patterns developed by the plurality of color toner development devices and the recycled toner development device.

The image forming method may further include controlling an amount of toner included in one pixel not to exceed a predetermined value.

The image forming method may further include operating the image forming apparatus in one of a plurality of image formation modes by which a user determines a use condition of the cyan, magenta, yellow, black, and recycled toners.

The image forming method may further include using, in one of the plurality of image formation modes, the plurality of color toner development devices excluding the recycled toner development device in an image forming operation.

The image forming method may further include performing, in one of the plurality of image formation modes, data generation processing of generating image patterns of cyan, magenta, yellow, black, and recycled toners to preferentially use the recycled toner and reduce consumption of the cyan, magenta, yellow, and black toners.

The image forming method may further include exclusively using the recycled toner in an image forming operation in one of the plurality of image formation modes.

The image forming method may further include using dry two-component developer, and not using the recycled toner development device if toner density of the recycled toner is lower than a predetermined value.

The image forming method may further include using the black toner in a development operation if the image forming apparatus is set to the mode in which the recycled toner is exclusively used in the image forming operation.

The image forming method may further include arranging in a line a plurality of image forming units, each configured to comprise an image carrying member, and storing the recycled toner in one of the plurality of image forming units at a most downstream position in a moving direction of the recording medium.

The image forming method may further include: providing the transfer device with an intermediate transfer member and an intermediate transfer member cleaning device configured to contact the intermediate transfer member and to collect toner adhered thereto; operating the image forming apparatus while driving the recycled toner development device excluding the plurality of development devices, when an image forming operation is not performed; applying a development bias voltage to generate a development electric field in a direction of not developing normally charged toner; and disposing the toner collected by the intermediate transfer member cleaning device as waste toner.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
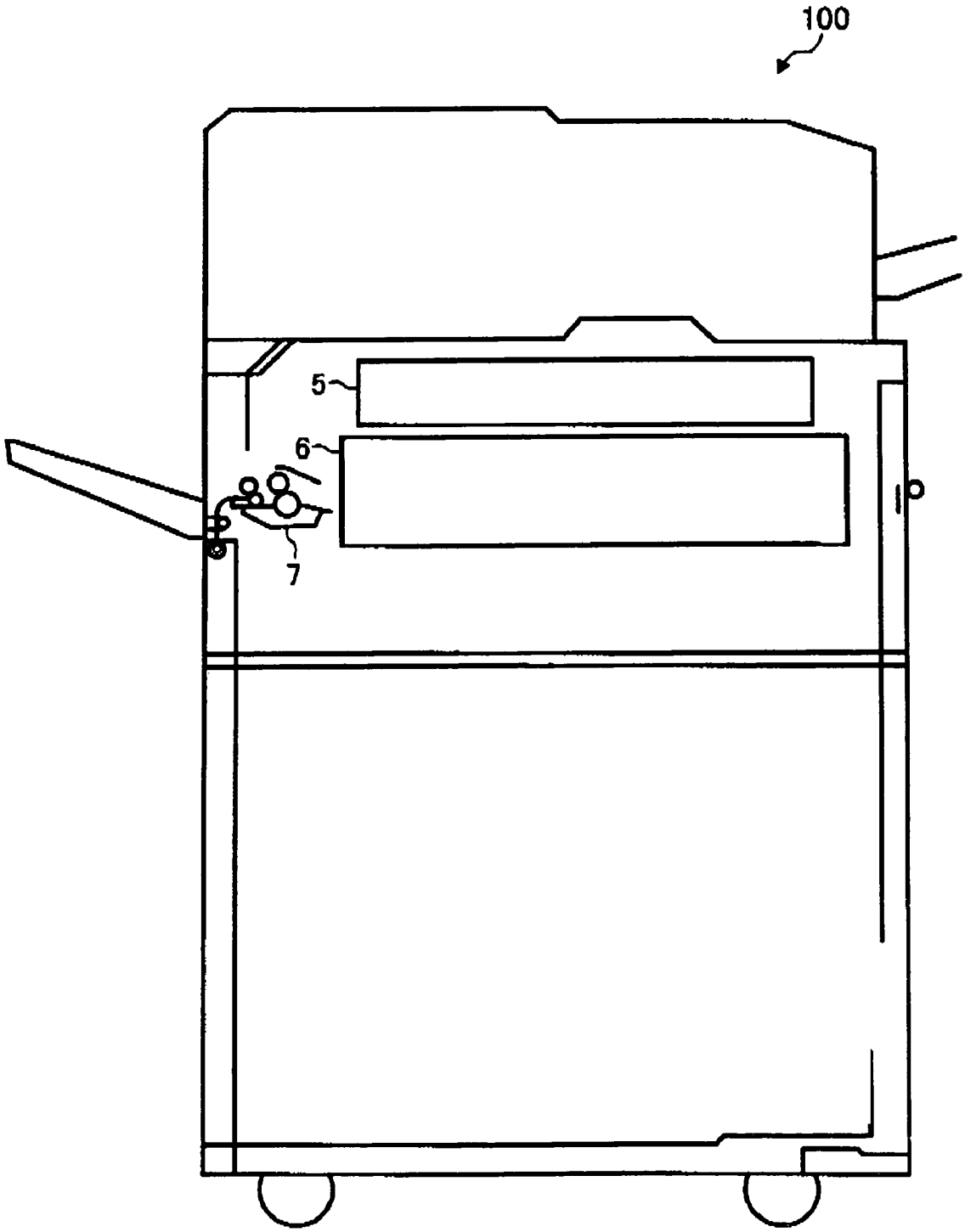
FIG. 1 is a schematic view of a tandem-system color image forming apparatus according to an embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner. Referring now to the drawings, wherein like reference numerals designate identical or corresponding parts throughout the several views, particularly to FIGS. 1 and 2, an image forming apparatus 100 according to an embodiment of the present invention is described.

Figure 2:
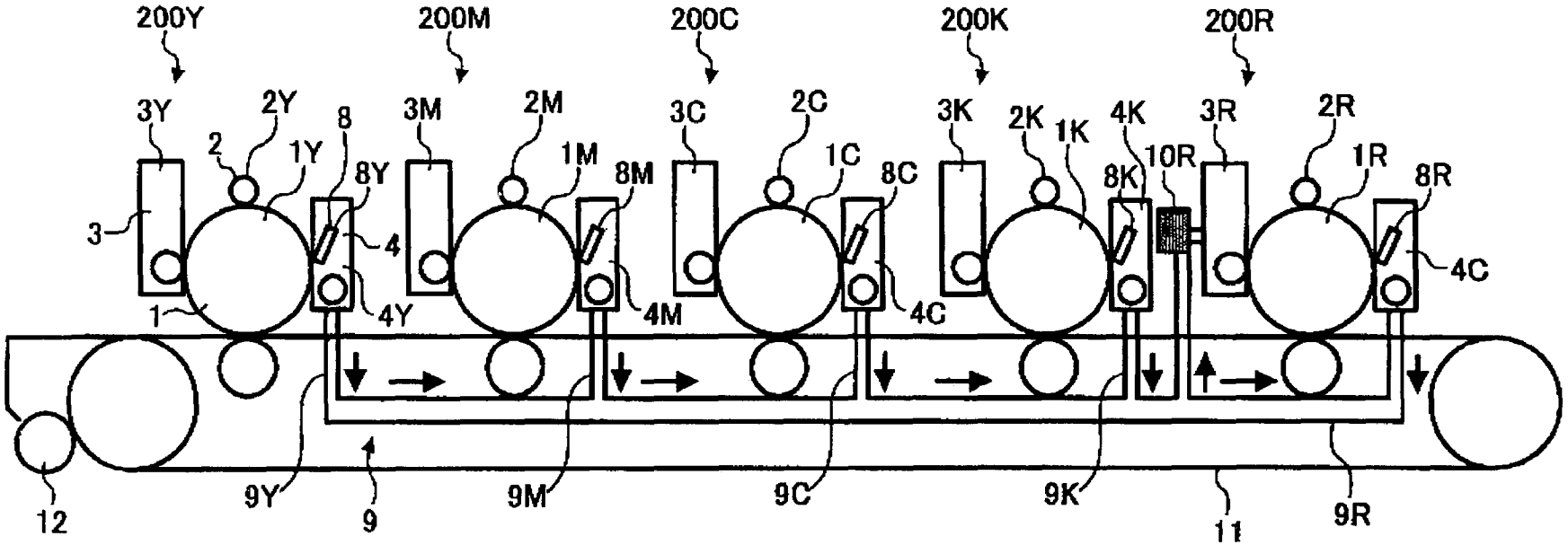
FIG. 2 is an enlarged view of an image forming mechanism used in the tandem-system color image forming apparatus shown in FIG. 1.

The image forming apparatus 100 schematically illustrated in FIG. 1 is a tandem-system color image forming apparatus (e.g., a color digital complex machine). The image forming apparatus 100 includes an exposure device 5, an image forming mechanism 6, and a fixing device 7. An enlarged view of the image forming mechanism 6 is illustrated in FIG. 2. The image forming mechanism 6 includes image forming units 200Y, 200M, 200C, 200K, and 200R, a toner conveying path 9, a toner collecting and mixing unit 10R, an intermediate transfer belt 11, and an intermediate transfer belt cleaning device 12. The toner conveying path 9 includes toner conveying paths 9Y, 9M, 9C, and 9K, and a main toner conveying path 9R. The image forming units 200Y, 200M, 200C, 200K, and 200R respectively include image carrying members (photoconductor drums in the present embodiment) 1Y, 1M, 1C, 1K, and 1R, changing devices 2Y, 2M, 2C, 2K, and 2R, development devices 3Y, 3M, 3C, 3K, and 3R, cleaning devices 4Y, 4M, 4C, 4K, and 4R. The cleaning devices 4Y, 4M, 4C, 4K, and 4R include cleaning blades 8Y, 8M, 8C, 8K, and 8R, respectively. The image forming units 200Y, 200M, 200C, 200K, and 200R form yellow toner images, magenta toner images, cyan toner images, black toner images, and recycled toner images, respectively, and are arranged in a line along the intermediate transfer belt 11.

In the following description of components of the image forming apparatus 100, a component is referred to by a number without a suffix of Y, M, C, K, or R in a description where the distinction of toner colors is not necessary, and is referred to by a number plus the suffix Y, M, C, K, or R where such distinction is necessary.

The image forming unit 200 is provided with the image carrying member 1, the charging device 2, the development device 3, and the cleaning device 4. The exposure device 5 applies a laser beam to a surface of the image carrying member 1 to form a latent image thereon. The development device 3 supplies toner to the latent image to develop the latent image into a visible toner image. The cleaning device 4 of the present embodiment uses, but is not limited to, the cleaning blade 8. For example, the cleaning blade 8 may be replaced by a fur brush roller or a magnetic brush. Similarly, the exposure device 5 used in the present embodiment is according to, but is not limited to, a laser system. The laser system, therefore, may be replaced by a LED (light-emitting diode) system, for example.

Data of an original document read by a scanner (not illustrated), data received by a facsimile unit (not illustrated), or a color image data sent from a computer connected to the image forming apparatus 100 is separated into the respective colors of cyan (C), magenta (M), yellow (Y), and black (K). Then, data is created for each of the respective colors and sent to the exposure device 5. The exposure device 5 applies laser beams to image areas on surfaces of the image carrying members 1Y, 1M, 1C, 1K, and 1R which have been uniformly charged by the respective charging devices 2Y, 2M, 2C, 2K, and 2R. Accordingly, electrostatic latent images are formed on the surfaces of the image carrying members 1Y, 1M, 1C, 1K, and 1R. Then, the development devices 3Y, 3M, 3C, 3K, and 3R develop the electrostatic latent images into visible toner images. The toner images formed on the image carrying members 1Y, 1M, 1C, 1K, and 1R are transferred at an appropriate timing to the intermediate transfer belt 11 (i.e., a first transfer operation), so that a toner image in which toners of different colors are superimposed is formed on the intermediate transfer belt 11. The thus formed toner image is transferred to a recording medium (i.e., a second transfer operation) and fixed thereon by the fixing device 7. As a result, a color image is formed on the recording medium.

The image forming unit 200R containing a mixed toner (i.e., a recycled toner), a color conversion operation, and arrangement of the image forming unit 200R at the most downstream position are sequentially described.

As illustrated in FIG. 2, the image forming units 200Y, 200M, 200C, 200K, and 200R are arranged in a line in an order of the yellow toner image forming unit 200Y, the magenta toner image forming unit 200M, the cyan toner image forming unit 200C, the black toner image forming unit 200K, and the recycled toner image forming unit 200R in a moving direction of a recording medium. The recycled toner image forming unit 200R is provided exclusively for forming toner images by using the recycled toner, and is located at the most downstream position in the moving direction of the recording medium in FIG. 2.

In the image forming unit 200, a cleaning blade 8 included in the cleaning device 4 contacts the image carrying member 1 to collect toner remaining on the image carrying member 1 without having been transferred to the recording medium. The toner thus collected for recycling is conveyed by such member as a spring coil (not illustrated) to the toner collecting and mixing unit 10R, which is provided immediately upstream of the development device 3R in the moving direction of the recording medium.

As illustrated in FIG. 2, toners collected from the respective toner image forming units 200Y, 200M, 200C, and 200K flow into the toner conveying paths 9Y, 9M, 9C, 9K, and 9R and then to the main toner conveying path 9R in the vicinity of the respective toner image forming units 200Y, 200M, 200C, and 200K. The toners are then mixed and conveyed to the toner collecting and mixing unit 10R. Alternatively, the toners collected from the respective toner image forming units 200Y, 200M, 200C, and 200K may be conveyed to the toner collecting and mixing unit 10R through respectively provided toner conveying paths.

The toner collecting and mixing unit 10R is described more in detail. The toner collecting and mixing unit 10R receives and mixes the toners collected from the toner image forming units 200Y, 200M, 200C, and 200K so that the toners of the four colors (i.e., Y, M, C, and K) are evenly dispersed. In the present embodiment, a screw-attached puddle member (not illustrated) is used to mix the collected toners. The toners evenly dispersed are then supplied to the development device 3R according to a toner replenishment command issued based on a result of detection by a toner density sensor (i.e., a P sensor) provided in the development device 3R.

A description is made on a method of detecting or predicting a state of the recycled toner collected in the development device 3R, and separating an original color image data into the colors of the yellow toner, the magenta toner, the cyan toner, the black toner, and the recycled toner contained in the development devices 3Y, 3M, 3C, 3K, and 3R, respectively.

Figure 6:
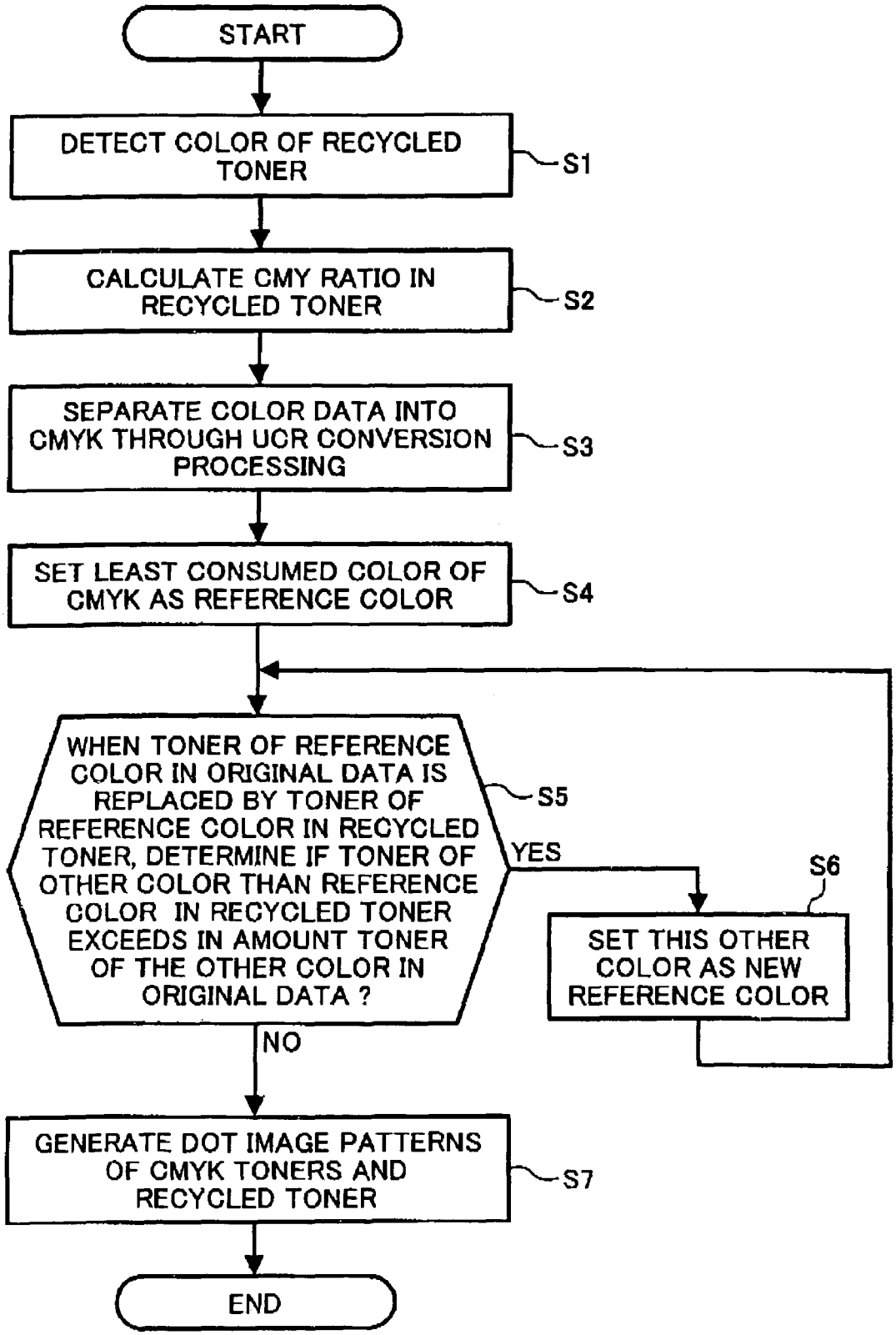
FIG. 6 is a flowchart illustrating a color conversion operation according to an embodiment of the present invention.

A flowchart shown in FIG. 6 illustrates a color conversion process according to the present embodiment. As illustrated in the flowchart, the color of the recycled toner contained in the development device 3R is first detected (Step S1) to perform the color conversion operation. A toner color detection device required for performing the conversion operation is provided in the development device 3R. In the present embodiment, a toner image pattern is developed on the image carrying member 1 by using the recycled toner contained in the development device 3R, and then the toner image pattern is detected by a color sensor, i.e., the toner color detection device. With this system, the color of the recycled toner contained in the development device 3R can be accurately detected, even if the yellow, magenta, cyan, and black toners collected in the development device 3R are different in a charged toner amount, and thus the recycled toner includes toners of different development abilities. Based on the color detected by the color sensor, a cyan-magenta-yellow ratio of the recycled toner is calculated (Step S2).

Figure 3:
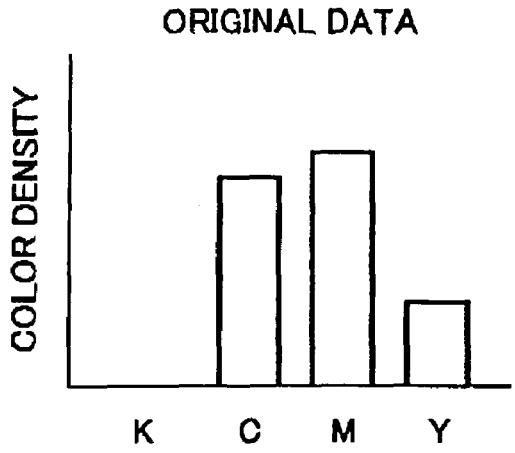
FIG. 3 is a graph illustrating densities of colors in an original image data before the UCR process.
Figure 4:
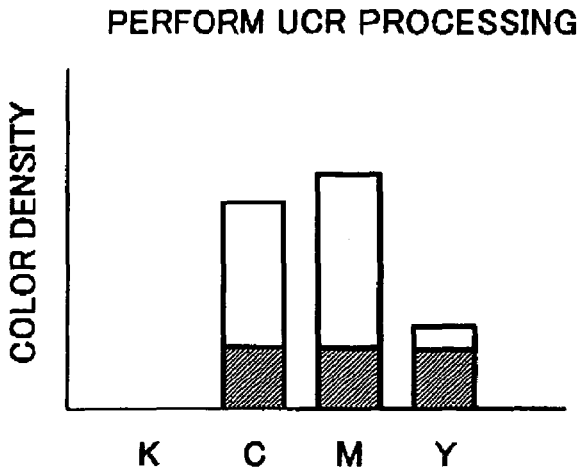
FIG. 4 is a graph illustrating densities of the colors in a UCR process.
Figure 5:
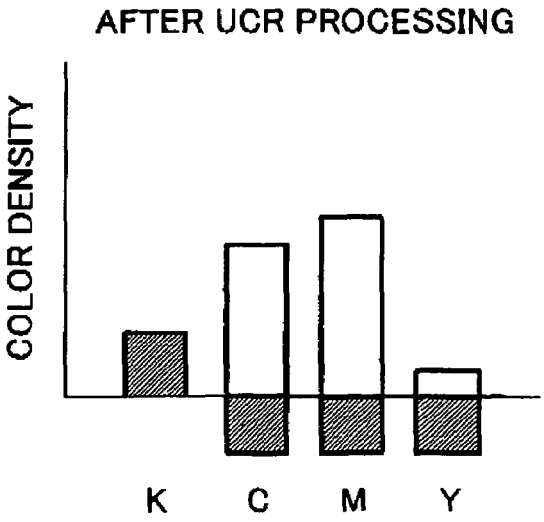
FIG. 5 is a graph illustrating densities of the colors after the UCR process.

FIGS. 3 to 5 schematically illustrate a procedure of a UCR (under color removal) operation. In the UCR operation, data of the original color image is separated into four colors of cyan, magenta, yellow, and black to form an image expressed by three primary colors of cyan, magenta, and yellow, as illustrated in FIG. 3.

If equal amounts of the cyan toner, the magenta toner, and the yellow toner are mixed, an obtained toner is black. In light of this, the cyan toner, the magenta toner, and the yellow toner are reduced by an equal amount as illustrated in FIG. 4, and instead the black toner of the equal amount is added, as illustrated in FIG. 5. By so doing, a total amount of consumed toners can be reduced. A ratio of toner reduced by the equal amount from each of the cyan, magenta, and yellow toners may be changed according to a type of image.

A description is made on a method of separating the data of the original color image into five colors (i.e., the color of the recycled toner and the four colors of cyan, magenta, yellow, and black), based on color data of the cyan, magenta, yellow, and black separated from the original color image.

Referring back to the flowchart of FIG. 6, the data of the original color image is first separated into the four colors of cyan, magenta, yellow, and black through the UCR conversion operation (Step S3). Then, the least used color among the three primary colors of cyan, magenta, yellow is determined as a reference color (Step S4). When the reference color in the original color image is replaced by the toner of the reference color included in the recycled toner, it is determined if the color of the original image can be appropriately reproduced, without being seriously affected by the toners of other colors than the reference color included in the recycled toner contained in the development device 3R. In other words, a mixing ratio of the three color toners (i.e., a cyan-magenta-yellow ratio) contained in the development device 3R is compared with a cyan-magenta-yellow ratio in the original color image data. Then, when the toner of the reference color included in the recycled toner is used to replace the reference color in the original color image data, it is determined if any of the toners of the other colors than the reference color included in the recycled toner contained in the development device 3R exceeds in amount the toner of the corresponding color in the original color image data.

FIGS. 7A and 7B and 8A to 8C illustrate examples of the color conversion operation performed based on the procedure shown in the flowchart of FIG. 6.

Figure 7A:
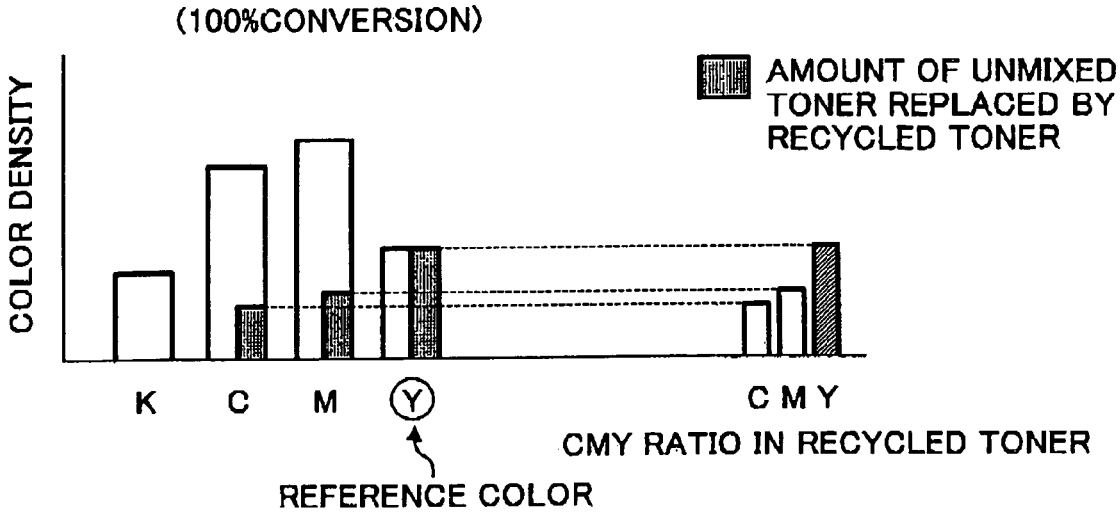
FIGS. 7A and 7B are diagrams illustrating a color conversion operation based on the procedure shown in the flowchart of FIG. 6.
Figure 7B:
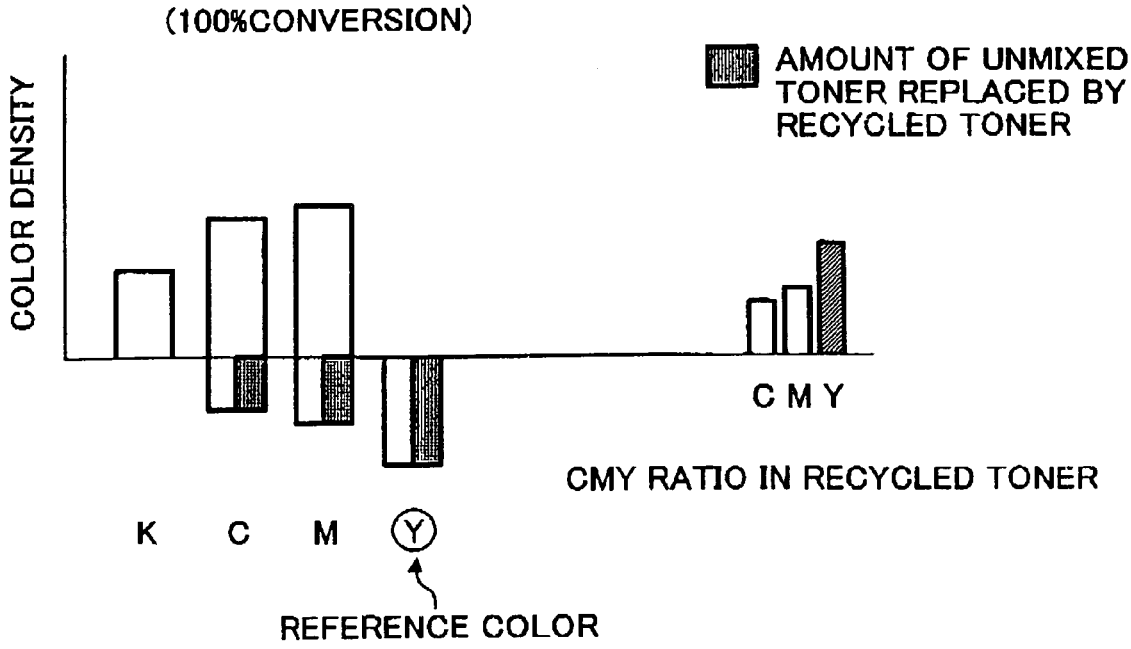

If the reference color in the original color image is replaced by the toner of the reference color included in the recycled toner, and if any one of the toners of the other colors than the reference color included in the recycled toner is smaller in amount than the toner of the corresponding color in the original color image data (NO in Step S5), the color conversion operation illustrated in FIGS. 7A and 7B is performed (Step S7). Specifically, a ratio of the toners included in the recycled toner to be used for an image forming operation is determined such that the reference color in the original color image is replaced by the toner of the reference color included in the recycled toner. With the ratio of the toners thus determined, an amount of the unmixed toners (i.e., the yellow, magenta, cyan, and black toners in the development devices 3Y, 3M, 3C, and 3K) used for the image forming operation can be reduced. In the examples shown in FIGS. 7A and 7B and 8A to 8C, a replacement ratio of the reference color (yellow in this case) in the original color image by the toner of the reference color in the recycled toner is set to, but not limited to, 100 percent.

Meanwhile, as illustrated in FIG. 6, if it is determined that any one of the toners of the other colors than the reference color included in the recycled toner exceeds in amount the toner of the corresponding color in the original color image (YES in Step S5), this color other than the reference color is newly set as the reference color (Step S6). Then, the determination process of Step S5 is repeated based on the newly set reference color until the toners of the color others than the reference color included in the recycled toner in the original color image do not exceed in amount the toners of the corresponding colors in the recycled toner (NO in Step S5).

Figure 8A:
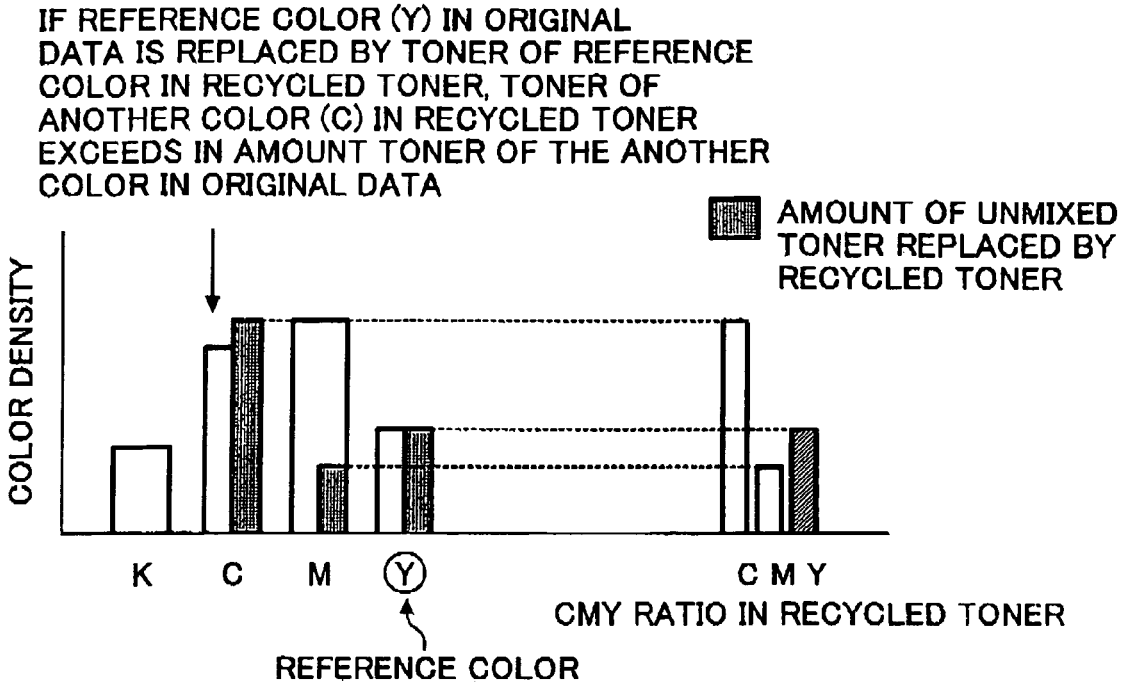
FIGS. 8A to 8C are diagrams illustrating another conversion operation based on the procedure shown in the flowchart of FIG. 6.
Figure 8B:
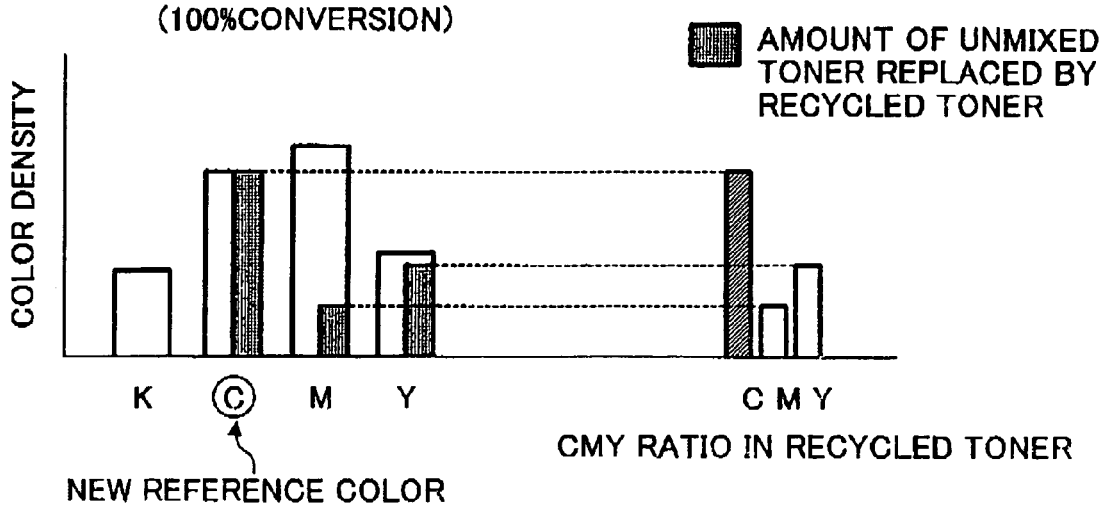
Figure 8C:
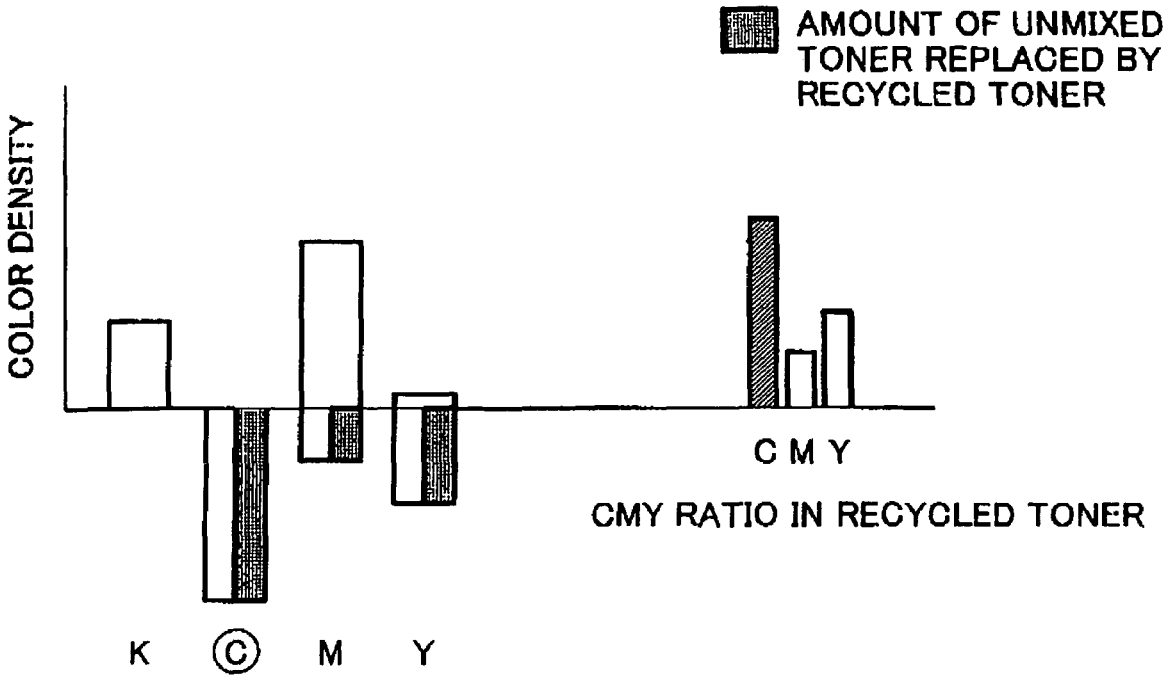

The processes of Steps S5 and S6 are described with reference to FIGS. 8A to 8C. If the toner of the first reference color (i.e., yellow) in the original color image is replaced by the yellow toner included in the recycled toner contained in the development device 3R, an amount of the cyan toner included in the recycled toner exceeds an amount of the cyan toner included in the original color image. Therefore, cyan is used as the reference color instead of yellow, and then it is determined if the cyan toner in the original color image can be replaced by the cyan toner included in the recycled toner. In this case, the toners of the other two colors than the reference color (i.e., magenta and yellow) are larger in amount in the original color image than in the recycled toner. Accordingly, the cyan toner in the original color image is determined to be replaceable by the cyan toner included in the recycled toner. Based on this determination, the color conversion operation is performed and color image data is produced for each of the yellow, magenta, and cyan toners contained in the development devices 3Y, 3M, and 3C, and the recycled toner contained in the development device 3R (Step S7).

Alternatively, to detect the color of the recycled toner, an amount of toner remaining on the image carrying member 1 and an amount of toner collected from the image carrying member 1 may be estimated based on history data of past image forming operations. Then, based on a ratio of the yellow, magenta, cyan, and black toners collected from the image carrying members 1Y, 1M, 1C, and 1K, a yellow-magenta-cyan-black ratio in the recycled toner contained in the development device 3R may be calculated.

As described above, according to the present embodiment, the color of the toner developed by the development device 3R is detected, and data of the detected color is sent to an image pattern generation processing device (not illustrated) which generates an image pattern developed by the development device 3R. Then, based on the data, color data is generated for each of the yellow, magenta, cyan, and black toners and the recycled toner contained in the development device 3R. Accordingly, even if the toners of the respective colors are consumed by different amounts after a relatively long-term use of the toners, and if the color of the recycled toner changes, hue of an original color image can be accurately reproduced.

The image forming apparatus 100 according to the present embodiment includes the four image forming units for the cyan, magenta, yellow, and black colors, respectively. Alternatively, the image forming apparatus may additionally include image forming units for other colors as well as the above four image forming units.

The present inventors conducted an image forming operation by using the color image forming apparatus 100 according to the present embodiment. The development device 3R stored in advance developer including toner consisting of 20 percent cyan toner, 50 percent magenta toner, 30 percent yellow toner, and 0% black toner. Toner density of the developer was set to be 5 percent by weight. The replacement ratio of the toner of the reference color in the original color image by the toner of the reference color included in the recycled toner contained in the development device 3R was set to be 80 percent.

Under the initial conditions as described above, three types of images, i.e., images of a landscape, a figure portrait, and a combination of text and image, were reproduced by the image forming apparatus 100. Specifically, a thousand copies were reproduced from each of the three images, and every hundredth copy was visually examined for tone. Color quality of the examined copies were all found to be at an acceptable quality level.

Figure 9:
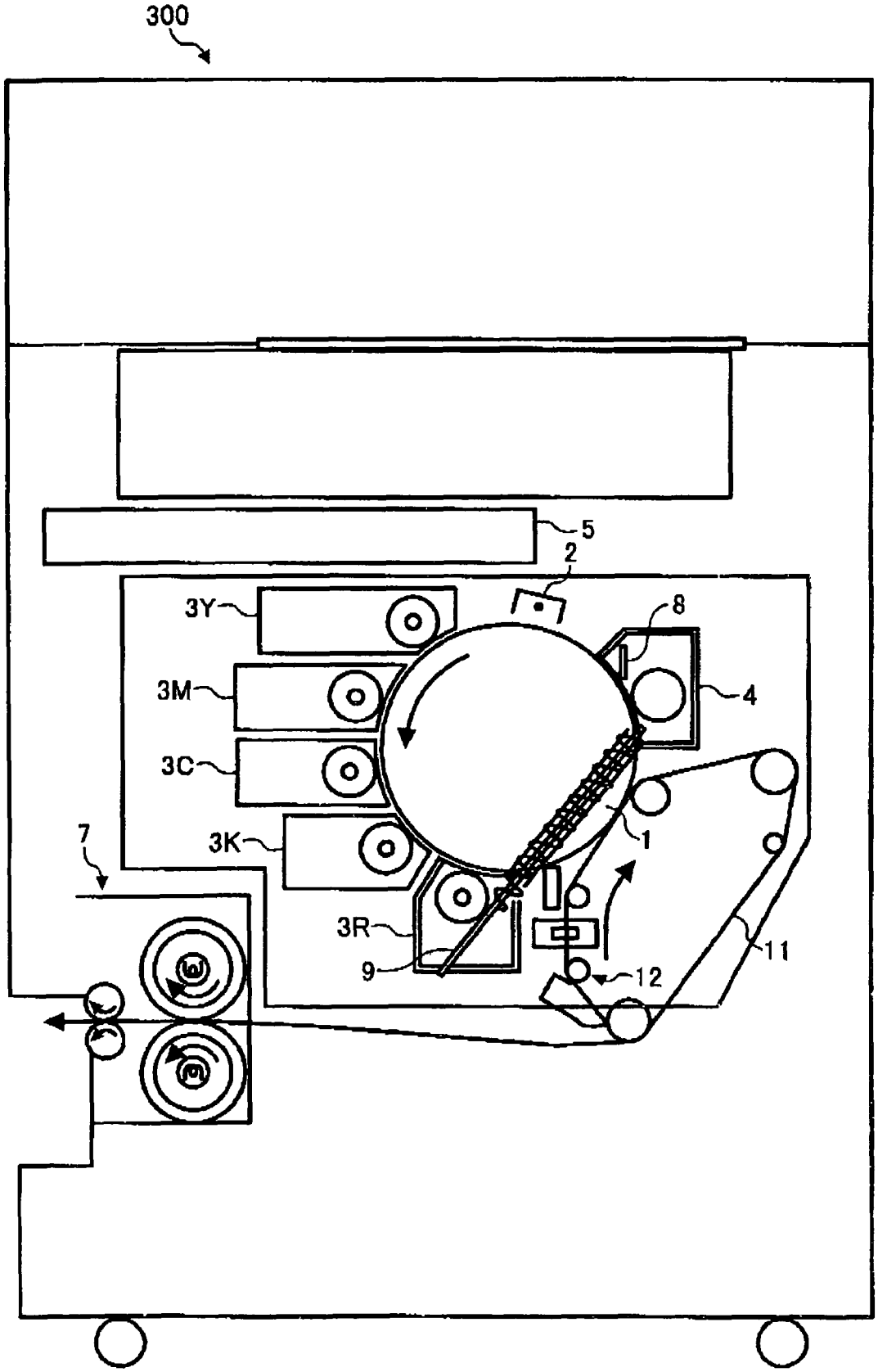
FIG. 9 is a schematic view of a color image forming apparatus according to another embodiment of the present invention, in which development devices are provided around an image carrying member.

The color image forming apparatus according to the present embodiment may be alternatively configured as a color image forming apparatus 300 shown in FIG. 9, wherein the development devices 3Y, 3M, 3C, 3K, and 3R are arranged around a single image carrying member.

Further, the dry two-component developer used in the color image forming apparatus according to the present embodiment may be replaced by wet-type developer.

If use of the mixed toner (i.e., the recycled toner) in place of the black toner is increased in a color data generation operation, an amount of toner adhered to each of pixels increases. As a result, toner of an amount greater than a maximum toner amount allowed in a typical image forming apparatus not having a recycled toner development may adhere to the each pixel. Excessive superimposition of toner may cause such problems as scattering of the toner and insufficient fixation of toner in a transfer operation. Excessive adhesion of toner is thus undesirable in terms of image quality.

In light of the above, according to an embodiment of the present invention, a toner use ratio calculation unit (not illustrated), which calculates ratios of the toners in the development devices 3Y, 3M, 3C, 3K, and 3R used for the image forming operation, is additionally provided with a total toner amount regulating device.

Although the ratios of the cyan, magenta, and yellow toners included in the recycled toner can be obtained, the ratio of the black toner included in the recycled toner is unknown. In the present embodiment, therefore, a maximum toner amount for a pixel is calculated based on the detected color of the recycled toner. An amount of toners used for producing a particular color becomes the largest, when the color is produced by mixing the yellow, magenta, and cyan toners without using the black toner. Therefore, the cyan-magenta-yellow ratio of the original color image is calculated and used in combination with the normal UCR operation using the unmixed toners contained in the development devices 3Y, 3M, 3C, and 3K. Accordingly, the total amount of toners superimposed can be controlled not to exceed a predetermined value.

As described above, a value of the maximum toner amount (i.e., the maximum amount of toners including the recycled toner) is included in an image conversion operation algorism. Accordingly, insufficient fixation of toner due to excessive adhesion of toner and scattering of toner due to an excessively thickened toner layer can be reduced.

According to the present embodiment, a user of the image forming apparatus can select a use condition of the development device 3R from a plurality of modes, from a display panel provided on the image forming apparatus or a printer driver of a computer connected to the image forming apparatus.

For example, if the user selects a mode in which the image forming operation is performed by using the development devices 3Y, 3M, 3C, and 3K excluding the development device 3R, the image forming unit 200R including the development device 3R is placed in a non-operation state, and the image forming operation is performed exclusively by the image forming units 200Y, 200M, 200C, and 200K which include the unmixed toners. This mode may be called a high-quality color image mode. If the user selects this mode, an image is formed exclusively by the unmixed toners. Accordingly, a high-quality image can be obtained.

Even in the high-quality color image mode, the toners collected for recycling by the cleaning blades 8Y, 8M, 8C, and 8K from the surfaces of the image carrying members 1Y, 1M, 1C, and 1K are conveyed to the collecting and mixing unit 10R and mixed therein. The toners thus collected are appropriately supplied to the development device 3R based on a result of detection of a toner image pattern by the toner density sensor, when the image forming operation is not performed. When the collected toners are supplied to the development device 3R, a mixing member (not illustrated) and a development roller (not illustrated) provided in the image forming unit 200R are rotated to evenly disperse the toners. With this rotating operation performed in the high-quality color image mode, the collected toners can be prevented from staying in a large amount in the collecting and mixing unit 10R. Further, when a recycled toner use mode is selected, the image forming operation using the recycled toner can be smoothly performed. Furthermore, a drastic change in the color of the recycled toner stored in the development device 3R can be prevented. Therefore, color controlling can be performed with relative ease, and toner images of a stable color tone can be obtained.

The user of the image forming apparatus can also select a mode in which data generation processing of generating image patterns of the respective colors is performed such that the mixed toner contained in the development device 3R is preferentially used to reduce consumption of the unmixed toners. This mode may be called an eco-color mode. In this mode, when the original image data including the yellow, magenta, and cyan colors is converted into color data of the respective colors including the color of the recycled toner, a ratio of the original image data subjected to the color conversion is set to be 100 percent so that consumption of the three unmixed toners (i.e., the yellow, magenta, and cyan toners) is minimized. Specifically, the image forming operation is performed by using two of the three unmixed toners, the unmixed black color, and the recycled toner. With recycled toner thus effectively utilized, the consumption of the unmixed toners can be reduced. Further, the color tones of the toner images can be maintained even when the recycled toner is used.

If a request for any particular image quality or operation speed is not received, the maximum toner amount may be excluded from the conditions described above. If the amount of the adhered toner is increased as a result of this exclusion of the maximum toner amount from the conditions, fixing conditions such as a fixing temperature and a fixing operation speed may be changed to sufficiently fix a toner image on the recording medium. In view of energy conservation, however, reducing a speed of conveying the recording medium is more preferable to increasing the fixing temperature.

The user of the image forming apparatus can further select a mode in which the image forming operation is performed by solely using the recycled toner contained in the development device 3R. In this mode, an image is formed by the recycled toner of a single color with no consumption of the unmixed toners. Accordingly, consumption of resources can be reduced. Since the image is formed solely by the recycled toner in this mode, the color control operation is unnecessary. Therefore, operation speeds of a color processing unit (not illustrated) and the image forming units can be increased. Further, the total amount of toners used is smaller in this mode than when the toners of the four colors are used. Therefore, the fixing temperature can be reduced, and a process linear velocity can be increased.

In the present mode, however, the color tone may vary within an image formed on one recording medium. To avoid this, toner replenishment to the development device 3R may be performed not during an image forming operation but during a time in which the image forming operation is not performed.

Since the present mode is intended for efficient use of the recycled toner, which is usually disposed in a typical background image forming apparatus. Therefore, if the image forming apparatus is commercially used, for example, charges for copies output from the image forming apparatus in the present mode may be excluded from a use fee of the image forming apparatus as a service.

As described above, the image forming apparatus according to the present embodiment is provided with the plurality of modes freely selectable by the user. Therefore, the user can decide whether to use the development device 3R, and whether to perform an image processing operation of generating dot image patterns developed by the development device 3R. Accordingly, the image forming apparatus according to the present embodiment can flexibly respond to the user's requests concerning the image quality, operation speed, and purpose of use. Further, the image forming apparatus according to the present embodiment is capable of forming a relatively high-quality image while using the recycled toner in a highly effective manner.

If an amount of the recycled toner collected into the development device 3R is relatively small, or if an amount of the recycled toner consumed is relatively large, the toner density of the recycled toner decreases. As a result, density of an obtained toner image also decreases. To solve this, according to the image forming apparatus of the present embodiment, if the density of the recycled toner in the development device 3R detected by a developer characteristic detection device (not illustrated) does not reach a predetermined value, the image forming operation is performed by using the development devices 3Y, 3M, 3C, and 3K containing the unmixed toners. The development device 3R containing the recycled toner is not used until a sufficient amount of the recycled toner is supplied in the development device 3R.

If the image forming operation is set to the mode in which the image forming operation is performed by exclusively using the recycled toner contained in the development device 3R, the black toner is used instead for the development operation. With this configuration, the decrease in density of an image can be prevented in this recycled toner use mode. Accordingly, images of stable quality can be obtained.

The present inventors further conducted image forming operations by using the image forming apparatus according to the present embodiment, and performance of the image forming apparatus was examined. In the operations, the development device 3R exclusively stored development carrier. The replacement ratio of the reference color in the original color image by the toner of the reference color included in the recycled toner contained in the development device 3R was set to be 80 percent. A toner density value of the recycled toner stored in the development device 3R was predetermined to be 3 percent by weight. If the toner density of the recycled toner is lower than 3 percent by weight, the image forming operation using the recycled toner was not performed. When the image forming operation was started, the toners collected from the respective image carrying members 1Y, 1M, 1C, and 1K were supplied to the development device 3R during a time in which the image forming operation is not performed. When the toner density of the recycled toner in the development device 3R gradually increased and reached 3 percent by weight, the data generation processing of generating an image pattern developed by the development device 3R was performed. Then, a color image was formed by using the five development devices 3Y, 3M, 3C, 3K, and 3R which contain the cyan, magenta, yellow, black, and recycled toners, respectively. It was found from the examination that the image forming apparatus according to the present embodiment can form images in satisfactory quality for a relatively long time period, with the images not penetrating to a non-image area in which images are not supposed to be formed, and without the carrier adhered to the images.

The present inventors also conducted an image forming operation in which the toner density value of the recycled toner stored in the development device 3R was predetermined to be 2 percent by weight. The development device 3R was operated when the toner density of the recycled toner reached 2 percent by weight. In this case, however, the density of an image became insufficiently low and unstable, and such defect as adhesion of the carrier to the image was observed.

With the image forming apparatus of the present embodiment configured as described above, even if the toner density of the recycled toner stored in the development device 3R decreases, images of sufficient quality can be obtained.

In the tandem-system image forming apparatus 100 in which the image forming units including a plurality of color toners are arranged in a line, the image forming unit 200R containing the recycled toner is placed at the most downstream position in the moving direction of the recording medium.

With the image forming apparatus 100 thus configured, contacts of the recycled toner contained in the development device 3R with the image forming units 200Y, 200M, 200C, and 200K containing the toners of the other colors can be reduced. As a result, the recycled toner is not transferred from the recording medium back to the image carrying members 1Y, 1M, 1C, and 1K for the respective yellow, magenta, cyan, and black toners, which are located upstream of the image forming unit 200R. Accordingly, such defect as toner filming is reduced.

The recycled toner stored in the development device 3R becomes more deteriorated and adhesive over time than the unmixed toners stored in the development devices 3Y, 3M, 3C, and 3K. If toner of relatively high adhesiveness is directly transferred to the intermediate transfer member, a ratio of toner transferred from the intermediate transfer member to the recording medium decreases in the second transfer operation. In transferring the recycled toner to the intermediate transfer member, therefore, it is preferable to transfer the recycled toner on an unmixed toner. For this reason, too, the image forming unit 200R containing the recycled toner is preferably placed at the most downstream position in the moving direction of the recording medium.

The image forming apparatus according to the present embodiment is set to a maintenance mode at a constant frequency during a start-up of the image forming apparatus, and during a time in which the image forming operation is not performed. In this mode, the image forming apparatus is driven to operate without driving the development devices 3Y, 3M, 3C, and 3K excluding the development device 3R. Then, an electric filed is formed in an opposite direction to a direction of an electric field formed in a normal development operation. As a result, inversely charged toner included in the recycled toner in the development device 3R is adhered to the intermediate transfer member 6. The inversely charged toner adhered to the intermediate transfer member 6 is then removed by a cleaning device (not illustrated) which collects toner remaining on the intermediate transfer belt 11 and stored in one place as a final waste toner.

Due to a series of operations as described above, the defect in an image such as the penetration of the image into the non-image area can be prevented even when the recycled toner contained in the development device 3R is used. Accordingly, relatively high-quality images can be obtained for a substantially long time period.

The present inventors operated the image forming apparatus according to the present embodiment such that the image forming apparatus is placed in the maintenance mode at every hundredth page.

In the maintenance mode, the development device 3R excluding the other development devices 3Y, 3M, 3C, and 3K is operated, and a development bias voltage is applied to generate a development electric field in a direction of not developing normally charged toner. As a result, the inversely charged toner is developed on the image carrying member 1R. The inversely charged toner reacts to an electric field formed in the opposite direction to the direction of the electric field formed in the normal development. The inversely charged toner, therefore, becomes a factor deteriorating quality of an obtained image.

By selecting the maintenance mode, the inversely charged toner adversely affecting the development process can be regularly removed. Thus, the inversely charged toner is not accumulated in the development device 3R. Accordingly, relatively high-quality images can be obtained for a substantially long time period. The inversely charged toner is transferred from the image carrying member 1R to the intermediate transfer belt 11, and collected by the intermediate transfer belt cleaning device 12 provided on the intermediate transfer belt 11. The collected toner is stored in a waste toner container. The toner thus stored is charged to a polarity inverse to a polarity used in the development process, i.e., a polarity inappropriate for the development. Therefore, the toner stored in the waste toner container is disposed.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

The invention claimed is:

1. An image forming apparatus comprising:

a plurality of color toner development devices configured to store separate color toners;

a recycled toner development device configured to store recycled toner;

at least one cleaning device configured to remove toner remaining on at least one image carrying member after a transfer operation;

a toner collecting and supplying device configured to store and supply the removed toner to the recycled toner development device; and an image pattern generation device configured to generate image patterns developed by the plurality of color toner development devices and the recycled toner development device, based on a characteristic of developer and a color of the recycled toner stored in the recycled toner development device.

2. An image forming apparatus comprising:

a latent image forming device configured to form a latent image on at least one image carrying member;

a plurality of development devices configured to store dry developer for developing the latent image into a visible image, the plurality of development devices comprising:

a plurality of color toner development devices configured to store cyan, magenta, yellow, and black toners, respectively; and a recycled toner development device configured to store recycled toner;

a transfer device configured to transfer the visible image to a recording medium;

at least one cleaning device configured to remove toner remaining on the at least one image carrying member after a transfer operation;

a toner collecting and supplying device configured to store and supply the removed toner to the recycled toner development device;

a developer characteristic detection device configured to detect a characteristic of developer stored in the recycled toner development device;

a color detection device configured to detect a color of the recycled toner; and an image pattern generation device configured to generate image patterns developed by the respective plurality of development devices.

3. The image forming apparatus as described in claim 2, wherein the image pattern generation device controls an amount of toner included in one pixel not to exceed a predetermined value.

4. The image forming apparatus as described in claim 2, wherein the image forming apparatus is operated in one of a plurality of image formation modes by which a user determines a use condition of the cyan, magenta, yellow, black, and recycled toners.

5. The image forming apparatus as described in claim 4, wherein, in one of the plurality of image formation modes, the plurality of color toner development devices excluding the recycled toner development device are used in an image forming operation.

6. The image forming apparatus as described in claim 4, wherein, in one of the plurality of image formation modes, data generation processing of generating image patterns of cyan, magenta, yellow, black, and recycled toners is performed to preferentially use the recycled toner and reduce consumption of the cyan, magenta, yellow, and black toners.

7. The image forming apparatus as described in claim 4, wherein, in one of the plurality of image formation modes, the recycled toner is exclusively used in an image forming operation.

8. The image forming apparatus as described in claim 7, wherein the developer is dry two-component developer, and wherein the recycled toner development device is not used if toner density of the recycled toner detected by the developer characteristic detection device is lower than a predetermined value.

9. The image forming apparatus as described in claim 8, wherein the black toner is used in a development operation, if the image forming apparatus is set to the mode in which the recycled toner is exclusively used in the image forming operation.

10. The image forming apparatus as described in claim 9, further comprising:

a plurality of image forming units configured to be arranged in a line, each of the plurality of image forming units comprising:

an image carrying member, wherein the recycled toner is stored in one of the plurality of image forming units at a most downstream position in a moving direction of the recording medium.

11. The image forming apparatus as described in claim 10, wherein the transfer device comprises:

an intermediate transfer member, and an intermediate transfer member cleaning device configured to contact the intermediate transfer member and to collect toner adhered thereto, wherein, when an image forming operation is not performed, the image forming apparatus is operated with the recycled toner development device excluding the plurality of color toner development devices driven, wherein a development bias voltage is applied to generate a development electric field in a direction of not developing normally charged toner, and wherein the toner collected by the intermediate transfer member cleaning device is disposed as waste toner.

12. An image forming apparatus comprising:

a plurality of means for storing separate color toners;

means for storing recycled toner;

at least one means for removing toner remaining on at least one image carrying member after a transfer operation;

means for storing and supplying the removed toner to the means for storing recycled toner; and means for generating image patterns developed by the plurality of means for storing separate color toners and the means for storing recycled toner, based on a characteristic of developer and a color of the recycled toner stored in the means for storing recycled toner.

13. An image forming apparatus comprising:

means for forming a latent image on at least one image carrying member;

a plurality of means for storing dry developer for developing the latent image into a visible image, the plurality of means for storing dry developer comprising:

a plurality of means for storing cyan, magenta, yellow, and black toners, respectively; and means for storing recycled toner;

means for transferring the visible image to a recording medium;

at least one means for removing toner remaining on the at least one image carrying member after a transfer operation;

means for storing and supplying the removed toner to the means for storing recycled toner;

means for detecting a characteristic of developer stored in the means for storing recycled toner;

means for detecting a color of the recycled toner; and means for generating image patterns developed by the respective plurality of means for storing dry developer.

14. The image forming apparatus as described in claim 13, wherein the means for generating controls an amount of toner included in one pixel not to exceed a predetermined value.

15. The image forming apparatus as described in claim 13, wherein the image forming apparatus is operated in one of a plurality of image formation modes by which a user determines a use condition of the cyan, magenta, yellow, black, and recycled toners.

16. The image forming apparatus as described in claim 15, wherein, in one of the plurality of image formation modes, the plurality of means for storing cyan, magenta, yellow, and black toners excluding the means for storing recycled toner are used in an image forming operation.

17. The image forming apparatus as described in claim 15, wherein, in one of the plurality of image formation modes, data generation processing of generating image patterns of cyan, magenta, yellow, black, and recycled toners is performed to preferentially use the recycled toner and reduce consumption of the cyan, magenta, yellow, and black toners.

18. The image forming apparatus as described in claim 15, wherein, in one of the plurality of image formation modes, the recycled toner is exclusively used in an image forming operation.

19. The image forming apparatus as described in claim 18, wherein the developer is dry two-component developer, and wherein the means for storing recycled toner is not used if toner density of the recycled toner detected by the means for detecting a characteristic of developer is lower than a predetermined value.

20. The image forming apparatus as described in claim 19, wherein the black toner is used in a development operation, if the image forming apparatus is set to the mode in which the recycled toner is exclusively used in the image forming operation.

21. The image forming apparatus as described in claim 20, further comprising:

a plurality of image forming units arranged in a line, each of the plurality of image forming units comprising:

image carrying units, wherein the recycled toner is stored in one of the plurality of image forming units at a most downstream position in a moving direction of the recording medium.

22. The image forming apparatus as described in claim 21, wherein the means for transferring comprises:

an intermediate transfer device, and means for contacting the intermediate transfer device and collecting toner adhered thereto, wherein, when an image forming operation is not performed, the image forming apparatus is operated with the means for storing recycled toner excluding the plurality of means for storing cyan, magenta, yellow, and black toners driven, wherein a development bias voltage is applied to generate a development electric field in a direction of not developing normally charged toner, and wherein the toner collected by the means for contacting is disposed as waste toner.

23. An image forming method comprising:

storing separate color toners in a plurality of color toner development devices;

removing toner remaining on at least one image carrying member after a transfer operation;

collecting and supplying the removed toner to a recycled toner development device; and generating image patterns developed by the plurality of color toner development devices and the recycled toner development device, based on a characteristic of developer and a color of the recycled toner stored in the recycled toner development device.

24. An image forming method comprising:

storing cyan, magenta, yellow, and black toners in separate color toner development devices;

forming a latent image on at least one image carrying member;

developing the latent image into a visible image;

transferring the visible image to a recording medium;

removing toner remaining on the at least one image carrying member after a transfer operation;

collecting and supply the removed toner to a recycled toner development device;

detecting a characteristic of developer stored in the recycled toner development device;

detecting a color of the toner stored in the recycled toner development device; and generating image patterns developed by the plurality of color toner development devices and the recycled toner development device.

25. The image forming method as described in claim 24, further comprising:

controlling an amount of toner included in one pixel not to exceed a predetermined value.

26. The image forming method as described in claim 24, further comprising:

operating the image forming apparatus in one of a plurality of image formation modes by which a user determines a use condition of the cyan, magenta, yellow, black, and recycled toners.

27. The image forming method as described in claim 26, further comprising:

using, in one of the plurality of image formation modes, the plurality of color toner development devices excluding the recycled toner development device in an image forming operation.

28. The image forming method as described in claim 26, further comprising:

performing, in one of the plurality of image formation modes, data generation processing of generating image patterns of cyan, magenta, yellow, black, and recycled toners to preferentially use the recycled toner and reduce consumption of the cyan, magenta, yellow, and black toners.

29. The image forming method as described in claim 26, further comprising:

exclusively using the recycled toner in an image forming operation in one of the plurality of image formation modes.

30. The image forming method as described in claim 29, further comprising:

using dry two-component developer; and not using the recycled toner development device, if toner density of the recycled toner is lower than a predetermined value.

31. The image forming method as described in claim 30, further comprising:

using the black toner in a development operation, if the image forming apparatus is set to the mode in which the recycled toner is exclusively used in the image forming operation.

32. The image forming method as described in claim 31, further comprising:

arranging in a line a plurality of image forming units, each configured to comprise an image carrying member; and storing the recycled toner in one of the plurality of image forming units at a most downstream position in a moving direction of the recording medium.

33. The image forming method as described in claim 32, further comprising:

providing the transfer device with an intermediate transfer member and an intermediate transfer member cleaning device configured to contact the intermediate transfer member and to collect toner adhered thereto;

operating the image forming apparatus while driving the recycled toner development device excluding the plurality of development devices, when an image forming operation is not performed;

applying a development bias voltage to generate a development electric field in a direction of not developing normally charged toner; and disposing the toner collected by the intermediate transfer member cleaning device as waste toner.

* * * * *